US005458289A

United States Patent [19]

Cater

[11] Patent Number: 5,458,289

[45] Date of Patent: Oct. 17, 1995

[54] LIQUID DISPENSING APPARATUS WITH REDUCED CLOGGING

[75] Inventor: Miro S. Cater, Newtown, Conn.

[73] Assignee: Bespak Plc, Norfolk, United Kingdom

[21] Appl. No.: 190,923

[22] Filed: Feb. 3, 1994

Related U.S. Application Data

[63] Continuation-in-part of Ser. No. 25,417, Mar. 1, 1993, abandoned.

[51] Int. Cl.[6] ..... B05B 9/043; B05B 11/02

[52] U.S. Cl. ..... 239/119; 239/333; 222/321.2; 222/321.3

[58] Field of Search ..... 222/109, 110, 222/148, 321, 385, 321.2, 321.3, 321.7; 239/119, 333

[56] References Cited

U.S. PATENT DOCUMENTS

| | | | |
|---|---|---|---|
| 3,724,723 | 4/1973 | Slavinski . | |
| 4,057,176 | 11/1977 | Horvath . | |
| 4,089,442 | 5/1978 | Hafele et al. . | |
| 4,122,982 | 10/1978 | Giuffredi . | |
| 4,230,242 | 10/1980 | Meshberg . | |
| 4,274,560 | 6/1981 | Cater . | |
| 4,402,432 | 9/1983 | Corsette | 222/321 |
| 4,462,549 | 7/1984 | Saito et al. | 222/321 X |
| 4,516,727 | 5/1985 | Saito et al. | 239/333 |
| 4,735,347 | 4/1988 | Shultz et al. . | |
| 4,776,498 | 10/1988 | Maerte et al. . | |
| 4,830,284 | 5/1989 | Maerte . | |
| 4,986,453 | 1/1991 | Lina et al. . | |
| 4,991,747 | 2/1991 | Van Brocklin . | |
| 5,011,046 | 4/1991 | Graf et al. | 239/333 X |
| 5,100,029 | 3/1992 | Meshberg . | |
| 5,110,052 | 5/1992 | Graf et al. . | |
| 5,137,180 | 8/1992 | Kieras . | |
| 5,147,087 | 9/1992 | Fuchs . | |
| 5,163,588 | 11/1992 | Cater . | |
| 5,234,135 | 8/1993 | LaFosse et al. . | |
| 5,358,149 | 10/1994 | O'Neill | 222/321 |

FOREIGN PATENT DOCUMENTS

| | | |
|---|---|---|
| 451615 | 10/1991 | European Pat. Off. . |
| 2825428 | 12/1979 | Germany . |
| 8702225 | 4/1989 | Netherlands . |

*Primary Examiner*—William Grant
*Attorney, Agent, or Firm*—Beveridge, DeGrandi, Weilacher & Young

[57] ABSTRACT

A pump dispenser connected to a container of liquid has a first piston reciprocatable in a first cylinder for pumping a quantity of liquid at each depression of the piston. A valve member received within a channel in the first piston is spring biassed into a position in which a dispensing outlet is normally closed and is movable to release liquid in response to excess liquid pressure in the first chamber. A cylindrical extension to the valve member defines a conduit communicating with liquid in the container and is separable from the valve member to open a liquid inlet port for recharging the first chamber. A second piston is movable in tandem with the first piston and cooperates with a second cylinder to provide suction on a return stroke of the pistons which is utilised to remove residual liquid from a dispensing channel delivering pumped liquid to a nozzle. Residual liquid collected in the second chamber is returned to the container during the next subsequent actuating stroke of the pistons. An actuator mounted on the first piston communicates lost motion to the second piston and provides valve action for applying suction to the dispensing channel. The dispenser is particularly useful for water borne liquid products because its self cleaning action prevents clogging.

18 Claims, 8 Drawing Sheets

FIG. 8.
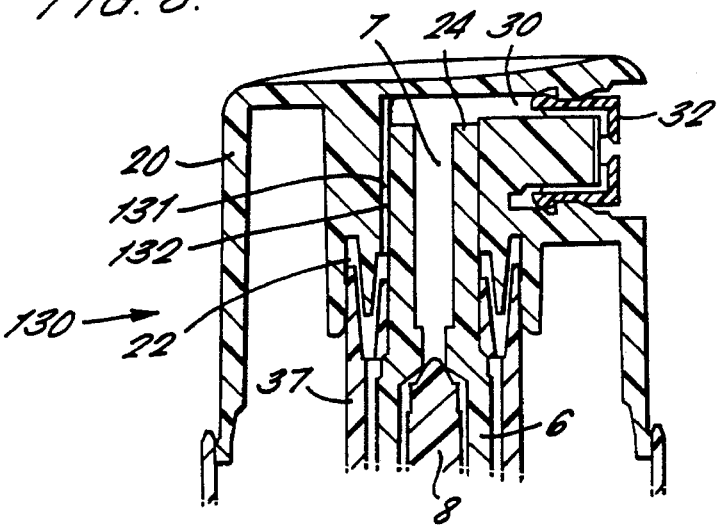
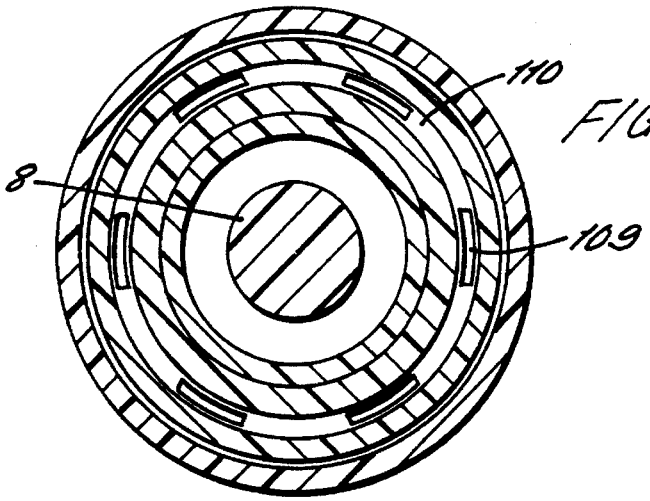
FIG. 9.
FIG. 10.
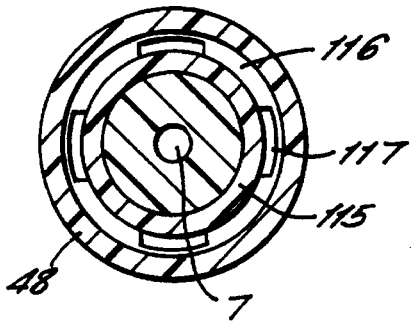
FIG. 11.
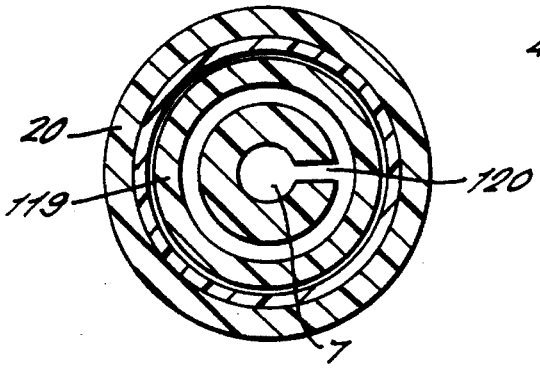

LIQUID DISPENSING APPARATUS WITH REDUCED CLOGGING

CROSS REFERENCE TO CO-PENDING APPLICATION

The present application is a continuation-in-part of U.S. patent application Ser. No. 08/025417 "Dispensing Apparatus" filed 1st Mar. 1993 (now abandoned). The contents of this co-pending application are incorporated by reference into the present application.

BACKGROUND OF THE INVENTION

This invention relates to an apparatus for dispensing liquid from a container using a liquid pumping means having an actuator defining a liquid dispensing channel through which liquid is dispensed. In particular, but not exclusively, the invention relates to an apparatus for dispensing water-borne liquid products.

Satisfactory operation of such apparatus relies upon the dispensing channel remaining unclogged by deposits which may accumulate due to congealed residues of the product between successive actuations.

It has been proposed in co-pending application U.S. Ser. No. 07/805,659 to purge the dispensing channel by releasing compressed air through the dispensing channel during a terminal portion of the dispensing stroke when actuating the liquid pumping means thereby purging any residue which might otherwise lead to clogging. A disadvantage of such compressed air purging is that the terminal portion of the dispensing stroke will dispense the residue as an aerosol spray but with progressively different characteristics to the normal spray and sputtering of relatively large droplets will be ultimately produced.

A further disadvantage is that in this arrangement the dispensing channel is purged satisfactorily only if the dispensing stroke is fully completed. If the travel of the actuator is insufficient to complete the normal dispensing stroke then the purging action will be curtailed or may even be completely omitted from the cycle of operation.

It is an object of the present invention to purge residues from the dispensing channel without degrading the spray characteristic of the apparatus during the dispensing stroke.

A further object of the present invention is to return the residues to the container.

A further object is to admit air to the container following actuation of the pumping means in order to avoid progresive build up of vaccuum in the container.

A further object of the present invention is to provide a liquid pumping means in which the relatively slidable parts maintain continuous sealing contact to thereby avoid clogging.

SUMMARY OF THE INVENTION

According to the present invention there is disclosed a method of dispensing liquid from a container comprising the steps of:

actuating a reciprocatable first pumping means having a first chamber of variable volume so as to displace liquid from the chamber during an actuating stroke of the first pumping means, recharging the first chamber with liquid from the container during a return stroke of the first pumping means, conducting liquid from the first chamber to a first nozzle via a dispensing channel during the actuating stroke such that a dispensed quantity of liquid is dispensed from the first nozzle and a residual quantity of the liquid remains in the dispensing channel, actuating during at least part of the actuating stroke and the return stroke of the first pumping means respectively a second pumping means having a second chamber of variable volume such that the volume of the second chamber is decreased during the actuating stroke and increased during the return stroke, connecting the second chamber by operation of a first valve means to the dispensing channel during the return stroke thereby withdrawing by suction the residual quantity of liquid into the second chamber, and connecting the second chamber by operation of a second valve means to an outlet port during a next subsequent actuating stroke.

An advantage of such apparatus is that by applying suction to the dispensing channel during the return stroke, the dispensing channel is purged of residues thereby avoiding the build up of deposits between successive actuations, but without modifying the normal spray characteristic during the dispensing stroke.

A further advantage of such apparatus is that purging air action is provided during the return stroke without the need for the dispensing stroke to be fully completed in the sense that the full available travel of the actuator need not be traversed.

Preferably the outlet port communicates with the container, and the method includes the step of thereby returning the residual quantity of liquid to the container from the second chamber.

An advantage of this method is that the residual liquid is returned to the container without the possibility of leaking to the exterior of the apparatus during subsequent handling in which the apparatus may be inverted.

Preferably the second chamber expands during the return stroke by a volume which is greater than the volume available within the dispensing channel to the residual quantity of liquid whereby the withdrawal of the residual quantity of liquid into the second chamber is accompanied by an inflow of air through the dispensing channel.

An advantage of this arrangement is that the inflow of air assists in draining the dispensing channel of liquid and makes available within the second chamber a volume of air which can be exhausted into the head space of the container together with the residual liquid during the next subsequent actuating stroke.

Preferably the first and second pumping means displace substantially equal volumes from the respective first and second chambers during the actuating stroke.

This enables the pressure in the head space of the container to be maintained substantially equal to that of the ambient air.

Conveniently the second valve means comprises a check valve whereby the second valve means opens in response to excess fluid pressure in the second chamber.

The first and second pumping means may be actuated by depression of respective first and second actuating members relative to the first and second cylinders, the first and second actuating members being connected by connection means providing lost motion between the first and second actuating members and wherein the first valve means is operated to open and close communication between the dispensing channel and the second chamber in response to relative movement between the first and second actuating members provided by the lost motion.

Advantageously the first pumping means comprises a liquid inlet valve which is operable to admit liquid from the container, to the first chamber and the method comprises the steps of closing the liquid inlet valve during the actuating stroke and closing the first valve means during the actuating stroke prior to opening the liquid inlet valve.

According to a further aspect of the present invention there is disclosed an apparatus for dispensing liquid from a container comprising a reciprocatable first pumping means having a first chamber of variable volume and operable during an actuating stroke in response to movement of an actuator to displace liquid from the first chamber and to recharge the first chamber with liquid from the container during a return stroke, a dispensing channel defined by the actuator and communicating between the first chamber and a first nozzle for conducting pumped liquid during the actuating stroke, a second pumping means operable during at least part of the actuating stroke and the return stroke respectively in response to movement of the actuator and defining a second chamber of variable volume such that the volume of the second chamber is decreased during the actuating stroke and increased during the return stroke, a first valve means operable to connect the second chamber to the dispensing channel during the return stroke to thereby withdraw by suction residual liquid from the dispensing channel into the second chamber and a second valve means operable to discharge fluid from the second chamber during a next subsequent actuating stroke.

According to a further aspect of the present invention there is disclosed an apparatus for dispensing liquid from a container comprising a first piston slidable in a first cylinder to vary the volume of an annular first chamber therein, a tubular first stem integral with the first piston and extending outwardly of the first chamber to define a liquid delivery duct, a valve member slidably received in the first stem and co-operable therewith in a rest position to close the delivery duct, the valve member having a separately formed cylindrical extension defining an inner wall of the first chamber and having an outer periphery maintained in continuous sliding engagement with an inner cylindrical wall of a tubular extension of the first cylinder, the cylindrical extension defining a conduit communicating with the container, a spring extending through the conduit and acting on the valve member to bias the valve member into the rest position, and connecting means providing lost motion between the valve member and cylindrical extension whereby the valve member and the cylindrical extension are movable into and out of engagement to respectively close and open a liquid inlet port communicating between the conduit and the first chamber, wherein the connecting means comprises co-operating stop formations of the valve member and cylindrical extension respectively co-operable to limit relatvie displacement therebetween.

Preferred embodiments of the present invention will now be described by way of example only and with reference to the accompanying drawings.

DESCRIPTION OF FIGURES

FIG. 8 is a sectioned elevation of a further alternative apparatus similar to the apparatus of FIGS. 4 to 7 but having a modified first stem and actuator;

FIG. 9 is a plan view sectioned at IX—IX of the apparatus of FIG. 4;

FIG. 10 is a plan view sectioned at X—X of the apparatus of FIG. 4 and

FIG. 11 is a plan view sectioned at XI—XI of the apparatus of FIG. 4.

In FIG. 1 an apparatus 1 has a first pumping means 2 constituted by a first piston 3 which is axially movable in a first chamber 4 defined by a first cylinder 5. A first stem 6 formed integrally with the first piston 3 is tubular so as to define a liquid delivery duct 7 through which liquid content of the first chamber 4 is expelled during a dispensing stroke during which the first stem moves downwardly towards the first cylinder 5.

Figure 1:
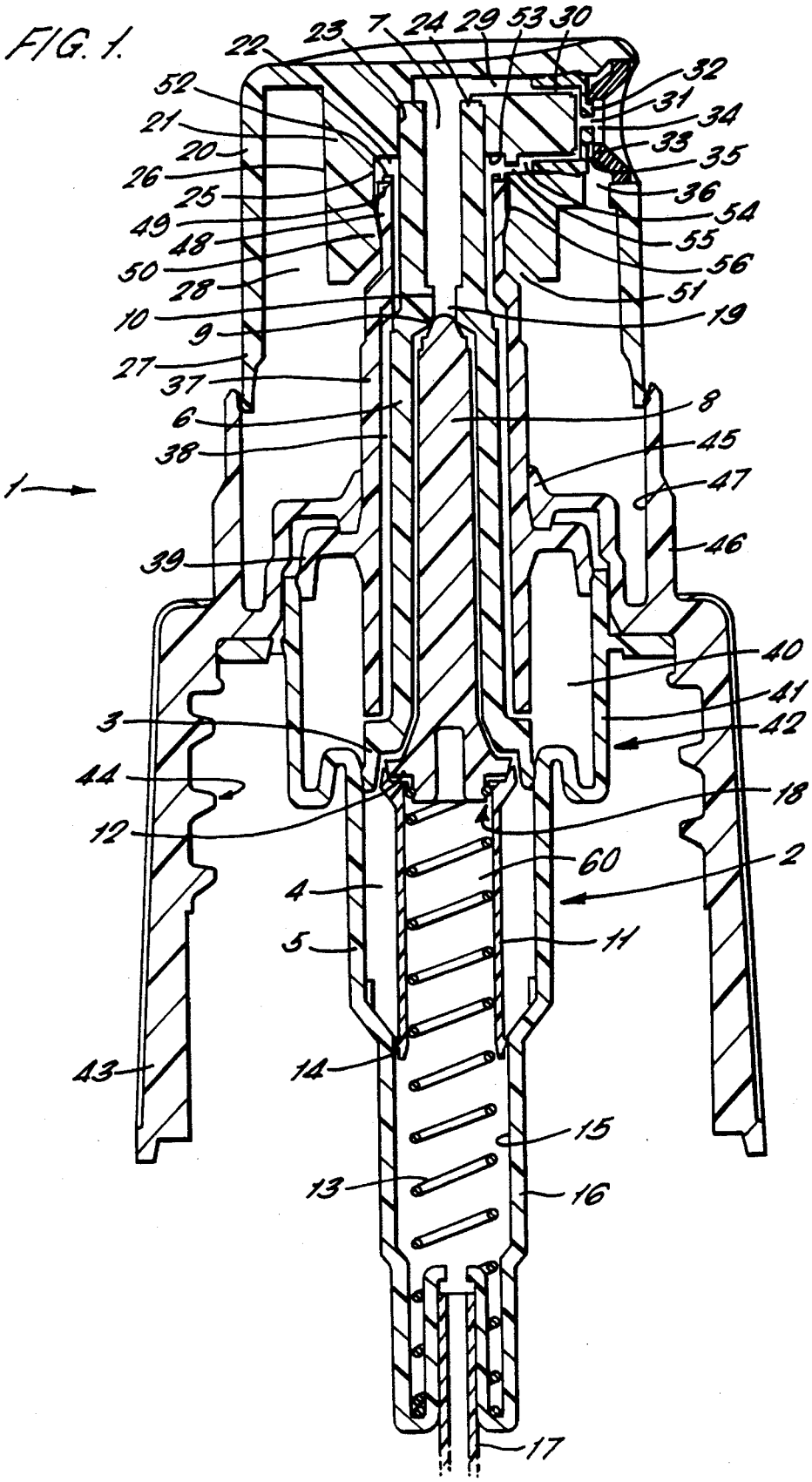
FIG. 1 is a sectioned elevation of a first embodiment of an apparatus in accordance with the present invention shown in the rest position.

A valve member 8 extends axially within the liquid delivery duct 7 and is axially movable into and out of engagement with an annular valve seat 9 constituted by a radially inwardly projecting flange 10 of the first stem 6.

The valve member 8 has an associated cylindrical extension 11 defining a conduit 60 which is formed separately from and is axially movable relative to an enlarged lower portion 12 of the valve member.

The enlarged lower portion 12 and the valve member 8 are upwardly biassed by a coil compression spring 13 such that the valve member cooperates with the valve seat 9 to form a liquid outlet valve means (8,9) which is normally closed as shown in the rest position in FIG. 1.

The cylindrical extension 11 has a lower end portion 14 which is slidingly engaged with an internal surface 15 of a tubular extension 16 depending from the first cylinder 5 and the tubular extension 16 is connected to a dip tube 17 through which liquid is drawn from a container (not shown).

In use, after priming, the dip tube 17, the tubular extension 16 and the first chamber 4 will remain filled with liquid, liquid being admitted to the first chamber during a return stroke of the first piston 3 via a liquid inlet port 18 defined between the cylindrical extension 11 and the valve member 8. During the dispensing stroke the liquid inlet port 18 is closed and liquid is expelled from the first chamber 4 through the liquid outlet valve means (8,9) which opens to define a liquid outlet port 19 between the valve seat 9 and the valve member 8. The liquid outlet port is opened by relative movement between the valve member 8 and the first stem 6 in response to excess pressure of liquid within the first chamber as a consequence of the valve member 8 having a smaller effective cross-section than the first cylinder 5.

The apparatus 1 has an actuator 20 having a stem engaging portion 21 defining a cylindrical socket 22. The socket 22 is stepped in diameter so as to have a first portion 23 within which an end portion 24 of the first stem 6 is received as a tight fit thereby securing the actuator 20 in fixed relationship to the first stem 6. The socket 22 has a second portion 25 of increased diameter through which the first stem 6 extends. The stem engaging portion 21 is generally cylindrical in external shape having an external cylindrical surface 26 which is co-axial with the socket 22 and the first stem 6.

A depending skirt 27 of the actuator is spaced radially outwardly of the external surface 26 to define an air chamber 28 therebetween.

The actuator 20 further defines a radially extending bore 29 which communicates with the first portion 23 of the socket 22 to thereby define a dispensing channel 30 through which liquid is dispensed so as to emerge from a first nozzle aperture 31 defined by a first nozzle 32 located in the bore.

The actuator 20 also comprises a second nozzle 33 which is located externally of the first nozzle 32 and which defines a second nozzle aperture 34 of greater diameter of the first nozzle aperture such that a spray of liquid emergent from the first nozzle aperture passes unimpeded through the second nozzle aperture.

The second nozzle 33 is spaced from the first nozzle 32 by an air gap 35 and the actuator 20 is further provided with an air ejection channel 36 communicating between the air gap and the air chamber 28.

A tubular second stem 37 is mounted coaxially upon the first stem 6 and spaced radially therefrom by axially extending ribs (not shown) so as to define therebetween an air duct 38. The second stem 37 is formed integrally with a second piston 39 which is slidably received within a second chamber 40 defined by a second cylinder 41. The second cylinder 41, the first cylinder 5 and the tubular extension 16 are integrally formed and together constitute a body 42 which is tubular and of stepped diameter to provide the respective chambers in which the second chamber 40 is of greater diameter than the first chamber 4. The body 42 is bonded to a casing 43 of the apparatus 1 which includes a screw fitting 44 for connection to the above mentioned container (not shown) and is formed integrally with an annular seal member 45 through which the second stem 37 is axially slidable.

The casing 43 further includes a tubular stem engaging portion 46 projecting upwardly into telescopic engagement with the depending skirt 27 thereby closing the air chamber 28, the skirt 28 being slidably received in engagement with an internal cylindrical surface 47 of the stem engaging portion.

The second stem 37 has an upper end portion 48 which is received axially movably within the socket 22 and which has a radially enlarged portion 49 located axially above a radially inwardly projecting annular shoulder 50 of the stem engaging portion. The shoulder 50 defines a constricted throat 51 through which the second stem extends.

Figure 2:
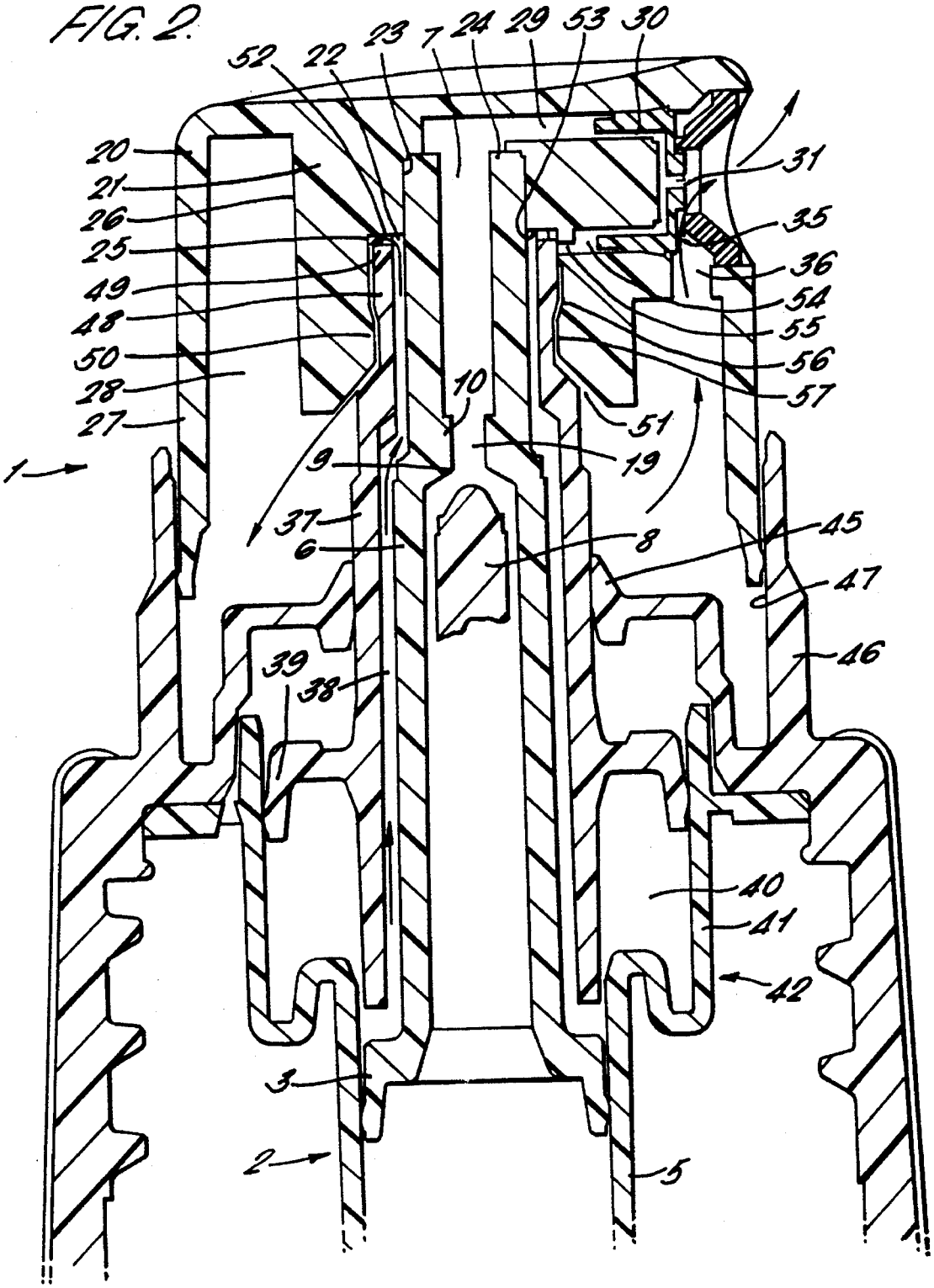
FIG. 2 is a sectioned elevation of the apparatus of FIG. 1 shown during the dispensing stroke with some detail of the liquid pumping means omitted.
Figure 3:
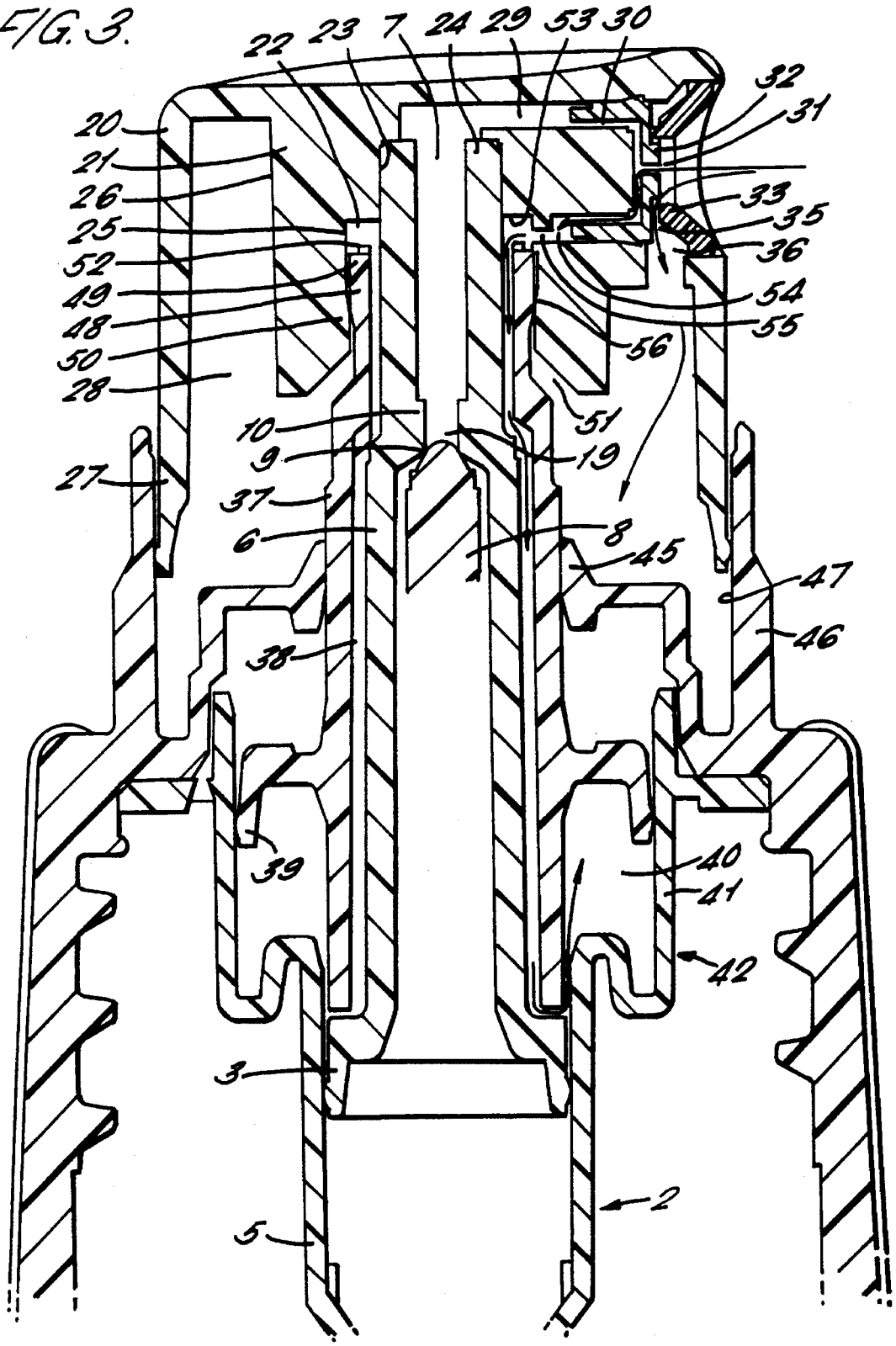
FIG. 3 is a sectioned elevation of the apparatus of preceding figures shown during the return stroke with some detail of the liquid pumping means omitted.

The radially enlarged portion 49 cannot readily pass through the throat 51 so that the radially enlarged portion 49 remains captive within the socket 22. During the dispensing stroke in which the actuator 22 is manually depressed, circumferentially spaced axially extending projections 52 formed on the end portion 48 are contacted by a shoulder 53 formed internally in the socket 22 so as to define the upper extremity of the second portion 25 of the socket and by means of this contact the second stem is axially displaced during the dispensing stroke in a downward direction as shown in FIG. 2. During the return stroke as shown in FIG. 3 the actuator moves upwardly in unison with the first stem by action of spring 13 and the shoulder 53 moves out of contact with the projections 52 to an extent limited by engagement between the radially enlarged portion 49 of the second stem and the shoulder 50 of the stem engaging portion 21. For the remainder of the return stroke the second stem is then moved upwardly until it reaches the rest position shown in FIG. 1.

The above described connection means between the second stem 37 and the combined assembly of the first cylinder 5 and actuator 20 provides lost motion in communicating actuator movement to the second stem.

The actuator further defines a radially extending duct 54 which in the rest position shown in FIG. 1 provides communication between the dispensing channel 30 and the air duct 38 via an aperture 55 formed in a side wall 56 of the socket 22. The duct 54 thereby constitutes an air inlet port for a second pumping means constituted by the second piston 39 and second chamber 40.

The aperture 55 is located such that during the dispensing stroke as shown in FIG. 2 the aperture is closed by sliding contact between the side wall 56 and the end portion 48 of the second stem 37. On the return stroke, however, as shown in FIG. 3, the aperture 55 is opened by virtue of the second stem 37 moving downward relative to the actuator 20 thereby providing communication between the air duct 38 and the duct 54 which in turn communicates with the bore 29 and the first nozzle aperture 31. In the rest position the aperture 55 continues to remain open.

In use, the actuator 20 is moved from its rest position of FIG. 1 by manual depression and during an initial displacement in which both the actuator and the first stem 6 move downwardly the second stem 37 remains stationary since the second piston 39 is frictionally engaged by contact with the second cylinder 41.

After this lost motion has been taken up the shoulder 53 makes contact with the projections 52 of the second stem, and thereafter during the dispensing stroke, the second stem 37 moves in unison with the first stem 6 in a downward direction.

Since liquid is relatively incompressible the increase in pressure within the first chamber 4 rapidly reaches a point where the valve member 8 is displaced to open the liquid outlet port 19 and a flow of liquid passes through the dispensing channel 30 to emerge as an aerosol spray from the first nozzle aperture 34.

Air within the second chamber 40 is compressed by movement of the second piston 39 during the dispensing stroke such that compressed air is generated in the air duct 38 from which it is able to escape via an air outlet port 57 as shown in FIG. 2, the outlet port being defined between shoulder 50 and the end portion 48 of the second stem.

Compressed air emerging from the air outlet port 57 enters the air chamber 28 which during the dispensing stroke is itself reduced in volume by relative movement between the actuator 20 and the stem engaging portion 46.

Compressed air within the air chamber 28 is released through the air ejection channel 36 into the air gap 35. Compressed air is then dispensed from the second nozzle aperture 34 so as to be entrained with the jet of aerosol droplets dispensed from the first nozzle aperture 31. This entrainment of compressed air assists in the evaporation of the water carrier from water-borne products dispensed in this manner. For certain products such as hair sprays, it is preferable for as much as possible of the water carrier to be evaporated prior to application of the spray.

On completion of the dispensing stroke the liquid in the first chamber 4 ceases to be pressurised and the flow of liquid is rapidly shut off by closure of the liquid outlet port 19. The actuator 20 is then released and begins to move upwardly in unison with the first stem 6 by action of the spring 13 which acts on the enlarged lower portion 12 of the valve member 8 and upon the cylindrical extension 11. During the initial stage of this movement the second stem 37 remains stationary, being held by frictional engagement between the second piston 39 and the second cylinder 41. The shoulder 20 then engages the radial enlargement 49 of the end portion of the second stem so that thereafter the second stem moves upwardly in unison with the first stem throughout the remainder of the return stroke. The air outlet port 57 is closed by this engagement and the aperture 55 becomes opened thereby opening the air inlet port and placing the air duct 38 in communication with the duct 54. On commencement of the return stroke the duct 54 will typically contain some residue of liquid. During the return stroke the second piston 39 moves upwardly thereby expanding the volume of the second chamber 40 and creating suction within the air duct 38. This suction is communicated via the duct 54 to the dispensing channel 30, and the residue is drawn by suction into the second chamber 40 where it is collected.

During the return stroke the volume of the air chamber 28 is also increased. This creates suction which draws through the air ejection channel 36 any residue of liquid on the external surface of the first nozzle 32 and any residue of liquid within the air gap 35. The liquid residue is collected and retained within the stem engaging portion 46 which prevents the liquid from seeping out on to the outer surfaces of the casing 43.

If in use the actuator 20 is depressed through only part of the available full travel of the first stem 6, the dispensed liquid will cease to emerge as an aerosol jet immediately after the travel is arrested because the liquid outlet port 19 closes when pressurisation of liquid in the first chamber 4 ceases. When the actuator 20 is released it will begin to travel upwardly in unison with the first step 6 and, as described above, lost motion between the first and second stems will open the air inlet port or aperture 55 and at the same time close the air outlet port 57. Suction will then be communicated to the delivery duct 7 throughout the remainder of the return stroke. It will therefore be apparent that the purging action provided by the apparatus 1 will be effective for both completed and partially completed dispensing strokes provided that the extent of motion is greater than the lost motion between the first and second stems 6 and 37.

An alternative apparatus 101 will now be described with reference to FIGS. 4 to 7 and FIGS. 9 to 11 using corresponding reference numerals to those of preceding Figures where appropriate for corresponding elements.

The apparatus 101 is similar to the apparatus 1 in that it comprises a first pumping means 2 constituted by a first piston 3 slidable in a first cylinder 5 to provide an annular first chamber 4 of variable volume. A first stem 6 integral with the first piston 3 has an end portion 24 secured in fixed relationship to an actuator 20 and defines a liquid delivery duct 7 for the discharge of liquid from the first chamber 4.

A valve member 8 is axially slidable within the liquid delivery duct 7 and is movable into and out of engagement with a valve seat 9. The valve member 8 has a cylindrical extension 11 constituting an inner wall of the first chamber 4 and which is axially movable relative to an enlarged lower portion 12 of the valve member.

The cylindrical extension 11 defines a conduit 60 and is captively retained in coaxial relationship with a core 102 integral with the lower portion 12 of the valve member 8 and having a cruciform cross section, cooperating annular flanges 103 and 104 being provided on the cylindrical extension 12 and the core 103 respectively. The flanges 103 and 104 constitute co-operating stop formations operable to limit axial separation of the extension 11 from the enlarged lower portion 12 of the valve member 8.

Figure 4:
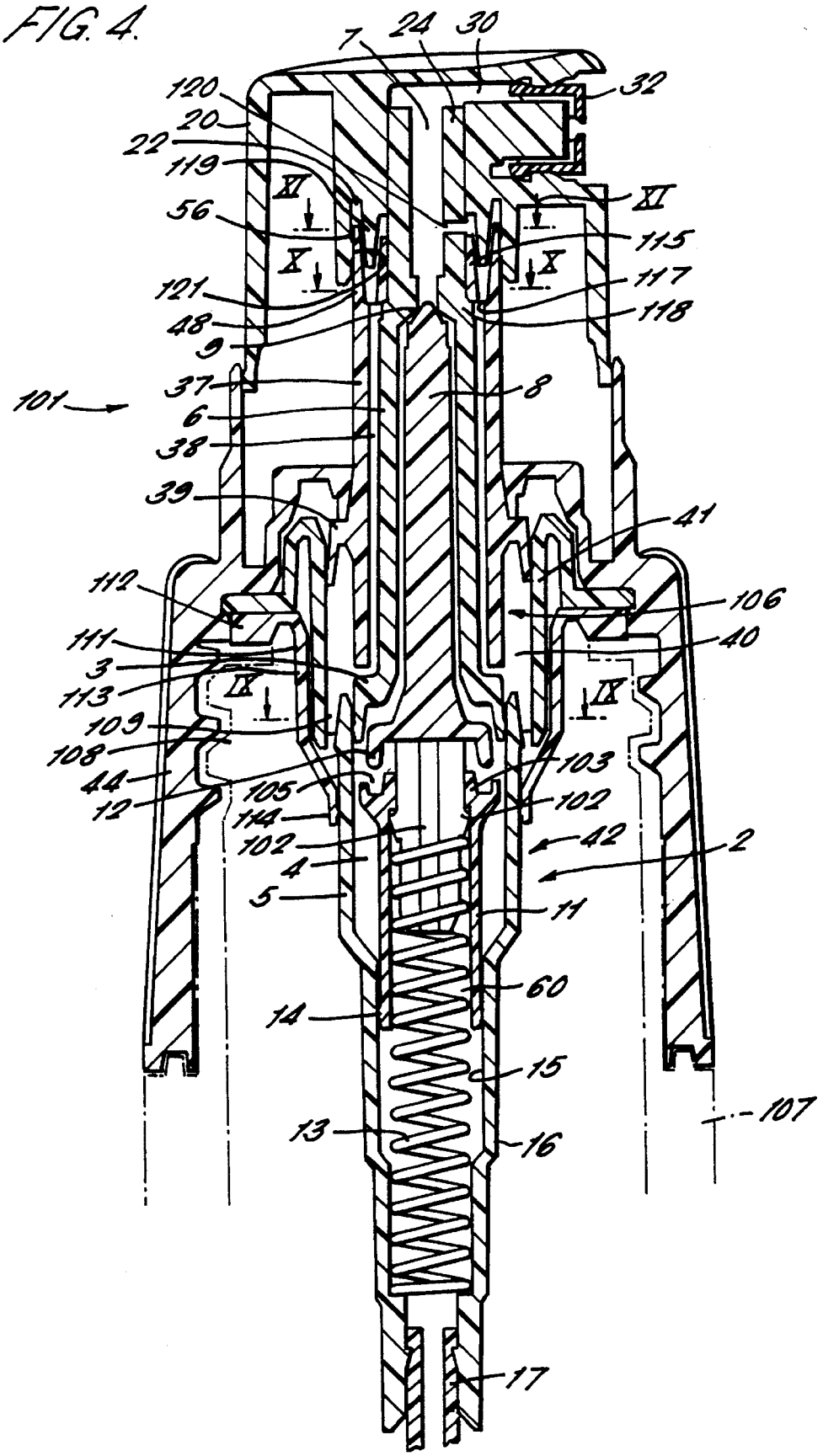
FIG. 4 is a sectioned elevation of an alternative apparatus shown in the rest position.

In the rest position shown in FIG. 4, the cylindrical extension 11 is spaced from the enlarged lower portion 12 to define a liquid inlet port 105 communicating between the conduit 60 and the first chamber 4.

A coil compression spring 13 contacts the core 102 and biases the core into the position shown in FIG. 4 such that in the rest position the first stem 6 projects fully in a direction away from the first chamber 4 and the actuator 20 is in its fully raised position.

A lower end portion 14 of the cylindrical extension 11 makes sliding contact with an internal surface 15 of a tubular extension 16 integral with the first cylinder 5.

Figure 5:
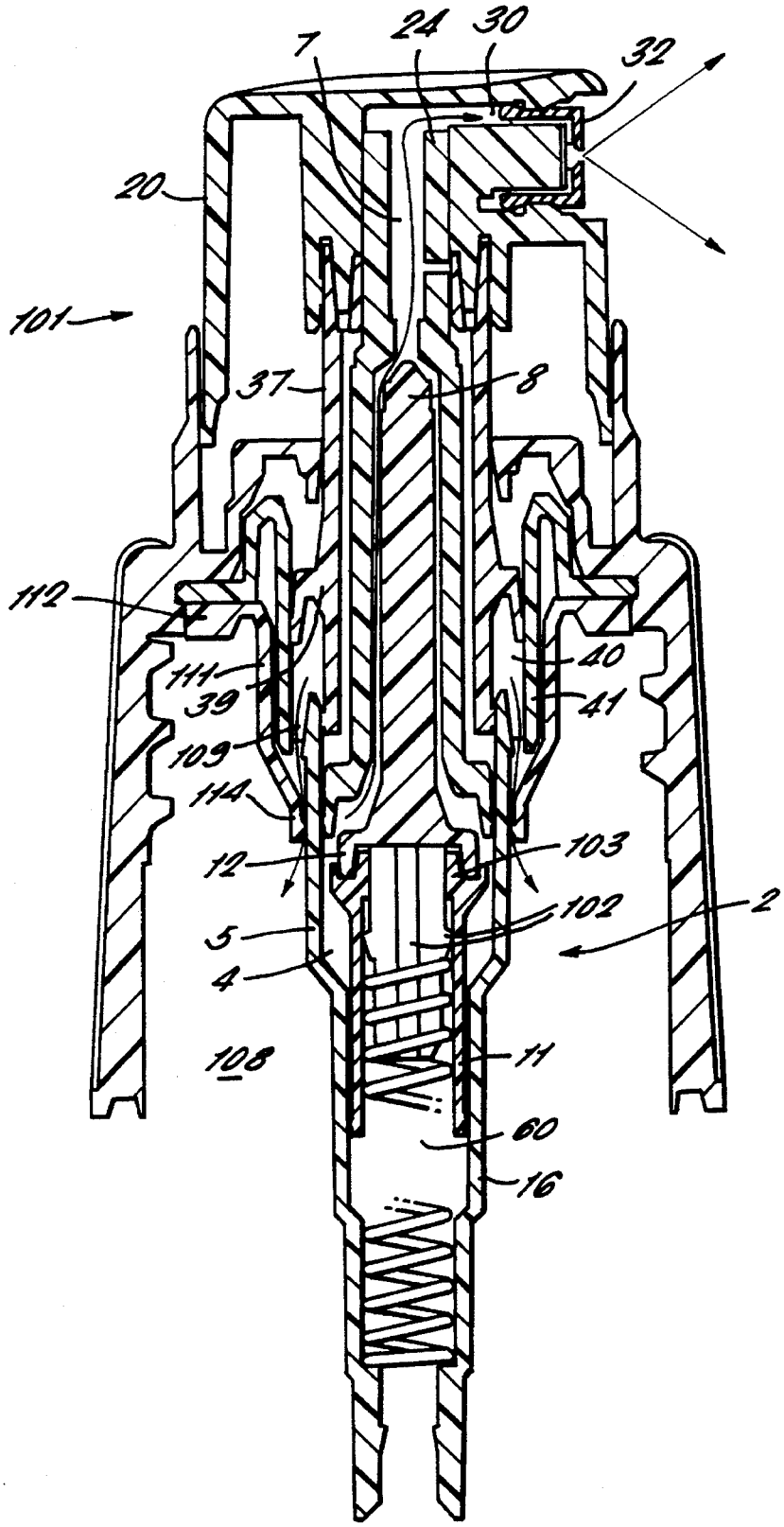
FIG. 5 is a sectioned elevation of the apparatus of FIG. 4 at an intermediate position during an actuating stroke.

Friction between the lower end portion 14 and the internal surface 15 maintains the cylindrical extension 11 in its initial rest position during an initial part of the actuating stroke when the actuator 20 and first stem are depressed. After taking up this initial lost motion, the liquid inlet port 105 is closed as shown in FIG. 5 allowing liquid pressure to be built up within the first chamber 4. Excess pressure in the first chamber 4 results in movement of the valve member 8 relative to the first stem 6 such that it becomes unseated from the seat 9 and liquid is dispensed under pressure through the liquid delivery duct 7.

Figure 6:
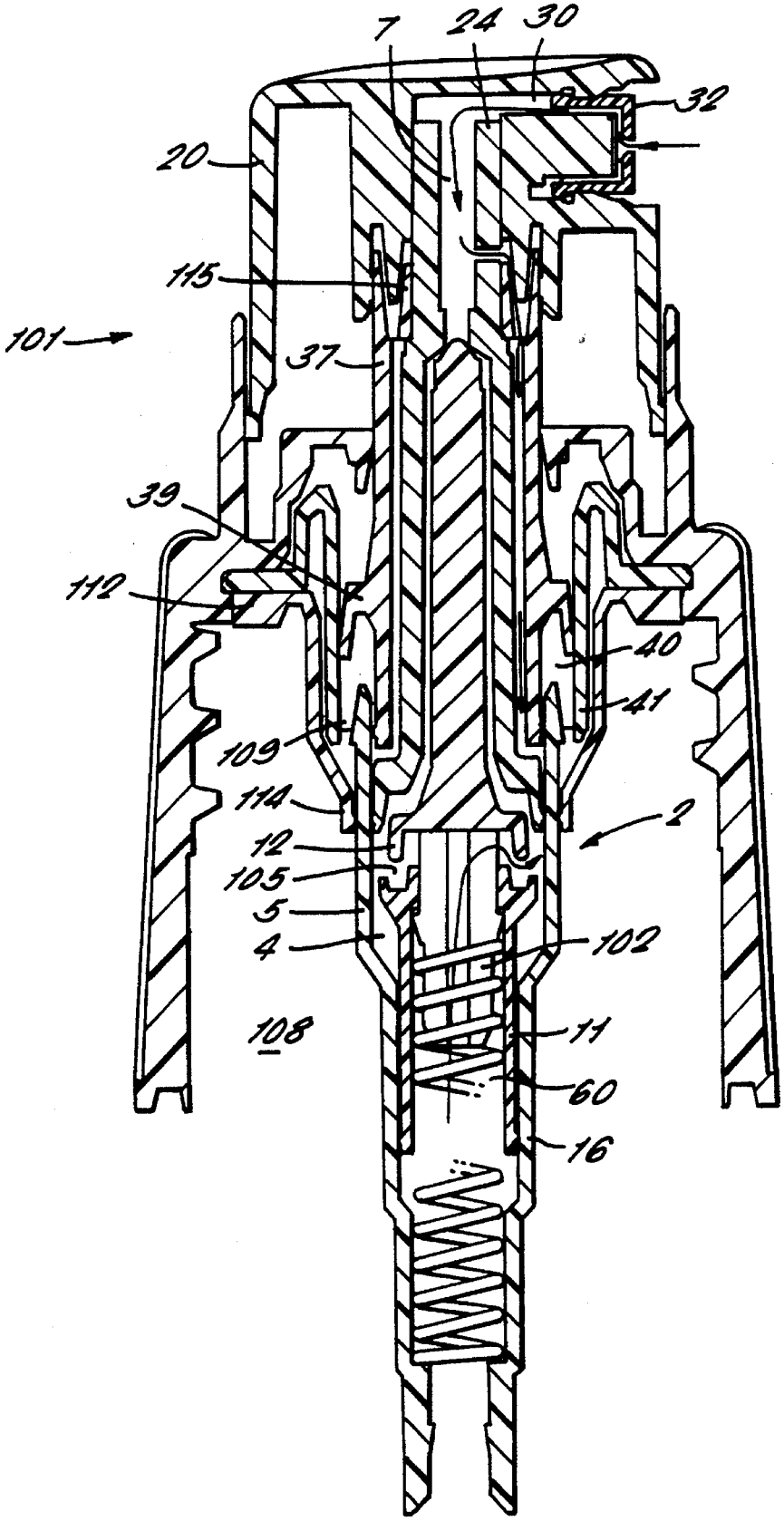
FIG. 6 is a sectioned elevation of the apparatus of FIGS. 4 and 5 at an intermediate position during the return stroke.

During the return stroke as shown in FIG. 6 in which the actuator 20 and first stem 6 move upwardly, frictional forces between the lower end portion 14 and the internal surface 15 result in the separation of the cylindrical extension 11 from the enlarged lower portion 12 thereby opening the liquid inlet port 105. Liquid drawn through the dip tube 17 from the container is then able to recharge the first chamber 4 via the liquid inlet port during the return stroke.

At successive actuations of the apparatus 101, liquid is thereby pumped by the first pumping means 2 such that pressurised liquid is expelled via a dispensing channel 30 so as to emerge in atomised form from an atomising nozzle 32.

At the end of each actuating stroke, a residual quantity of liquid will tend to remain within the dispensing channel 30 which is downstream of the valve seat 9 and upstream of the nozzle aperture 31 of the nozzle 32.

In order to remove the residual quantity of liquid, the apparatus 101 is provided with a second pumping means 106 constituted by a second piston 39 reciprocatingly slidable in a second cylinder 41 to define an annular second chamber 40 of variable volume.

The second cylinder 41 is coaxial with the first cylinder 5 such that the first stem 6 traverses axially the second cylinder and is received within a tubular second stem 37 integral with the second piston.

In FIG. 4 the apparatus 101 is shown connected to a container 107 by means of a screw fitting 44, the container having in its normal orientation as illustrated in the Figures a quantity of liquid contained in its lower portion and a volume of air occupying a head space 108.

As shown in FIG. 9, although the first and second cylinders 5 and 41 are formed integrally so as to comprise a body 42, there are six circumferentially equispaced slots 109 formed in an annular interface 110 between the respective cylinders such that in the normal upright orientation of the apparatus 101 as shown in FIG. 4 any liquid contained within the second chamber 40 is able to drain through the slots.

An annular resilient gasket 111 has a lip portion 112 providing a seal between the body 42 and the container 107 and further comprising a depending skirt 113 having an inwardly tapered inner periphery 114 which in the rest position as shown in FIG. 4 makes sealing contact with the external surface of the first cylinder 5. The skirt 113 thereby defines an outer surface of the second chamber 41. The gasket 111 has sufficient resilience to accommodate deformation of the inner periphery 114 in response to excess pressure within the second chamber 40 to allow the release of pressurised contents from the second chamber into the head space 108 so that the inner periphery 114 functions as a check valve.

An annular air duct 38 is defined between the tubular first and second stems 6 and 37 respectively and communicates with the second chamber 40. The second stem 37 has an upper end portion 48 which is received within a cylindrical socket 22 defined in the actuator 20 in coaxial relationship with the end portion 24 of the first stem 6. The end portion 48 of the second stem 37 is of thin walled tubular form and is provided with an inner tubular portion 115 of smaller diameter and which is connected integrally with the end portion by a web 116 defining four circumferentially spaced slots 117 as shown in FIG. 10.

The inner tubular portion 115 makes sliding contact with the end portion 24 of the first stem 6 and in the rest position as shown in FIG. 4 abuts against a shoulder 118 which acts as a stop to limit relative movement between the first and second stems.

The actuator 20 is provided with a tubular projection 119 which projects within the socket 22 so as to extend between the end portion 48 of the second stem and the inner tubular portion 115.

The end portion 48 of the second stem 37 has a cylindrical outer surface 121 which makes sliding sealing contact with the outer side wall 56 of the socket 22 thereby allowing a circumferential seal to be maintained between the actuator 20 and the external surface of the second stem 37 throughout relative movement between the actuator and the second stem.

A radially extending bore 120 is provided in the first stem 6 at a location downstream of the seat 9 so as to communicate between the liquid delivery duct 7 and the gap formed between the tubular projection 119 of the actuator and the inner tubular portion 115 of the second stem 37. This gap in turn communicates via the slots 117 with the air duct 38 and the second chamber 40.

During the actuating stroke of the apparatus 101, the initiation of downward movement of the actuator 20 moves the first stem 6 downwards in unison with the actuator while the second stem 37 initially remains stationary by virtue of frictional resistance between the second piston 39 and the second cylinder 41.

Lost motion between the actuator 20 and the second stem 37 is eventually taken up by contact between the actuator 20 and the end portion 48 of the second stem such that, as shown in FIG. 5, the tubular projection 119 makes sealing contact with the end portion 48 and the inner tubular portion 115.

Lost motion is also taken up between the core 102 moving downwardly with the first stem 6 and the cylindrial extension 11 which initially remains stationary due to frictional forces. The linear displacement required to take up the lost motion between the core 102 and cylindrical extension 11 is arranged to be slightly greater than the linear displacement required to take up lost motion between the actuator 20 and the second stem 37 so that the cylindrical extension 22 begins to move momentarily after the second stem 37. This difference in displacement ensures that pressurisation of liquid within the first chamber 4 does not commence until after the second chamber 40 has been isolated from the dispensing channel 30.

Continued travel of the actuator 20 is accompanied by movement in tandem of the first and second stems 6,37 together with the first and second pistons 3,39 thereby pressurising the contents of the first and second chambers 4,40. Air and any liquid accumulated within the second chamber 40 is progressively expelled from the second chamber through the check valve constituted by the gasket 111 so that air and/or liquid from the second chamber is delivered into the head space 108.

Figure 7:
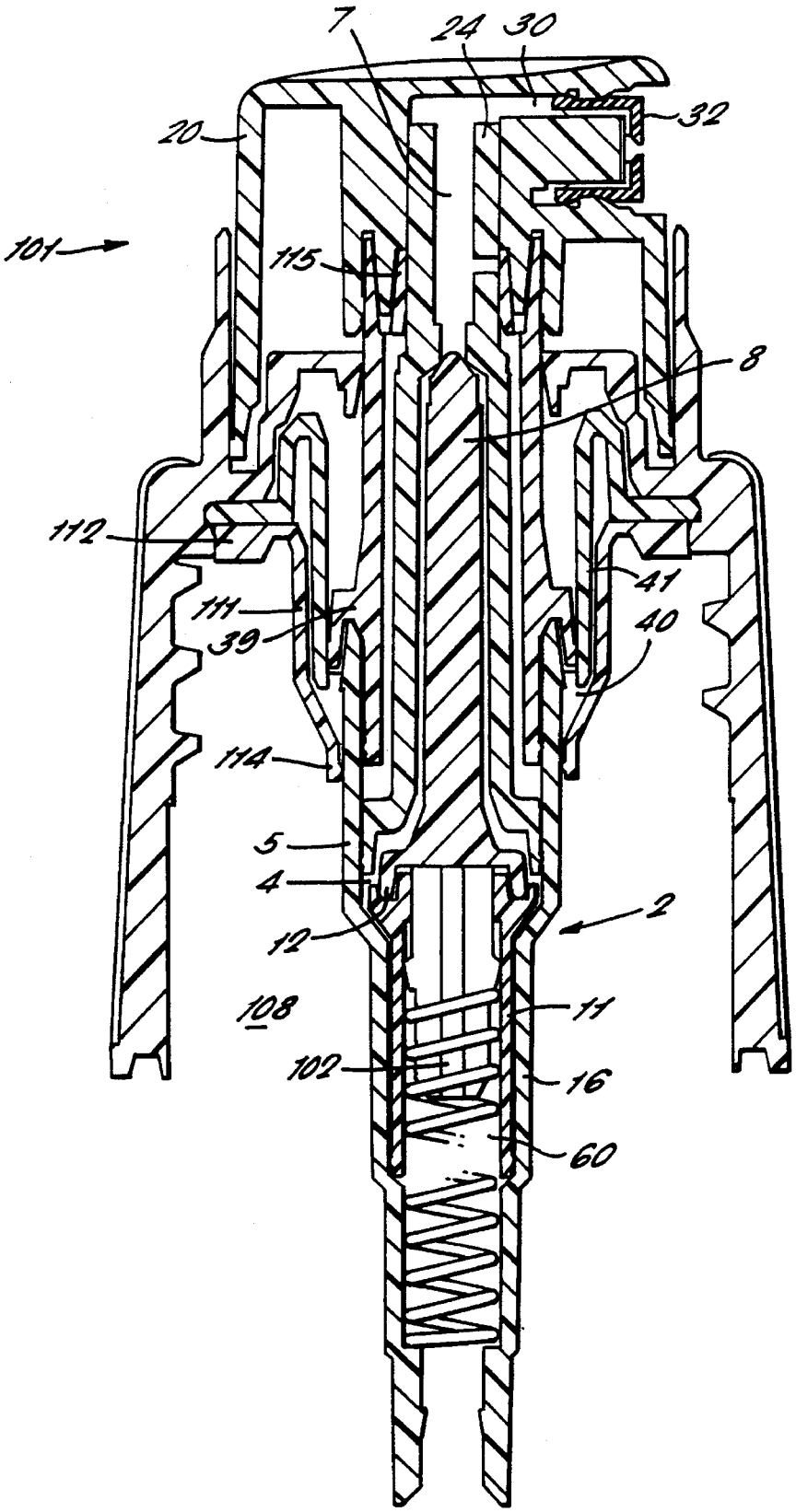
FIG. 7 is a sectioned elevation of the apparatus of FIGS. 4 to 6 showing the actuator in a fully depressed condition.

At the same time pressurised liquid from the first chamber 4 is expelled from the nozzle 32 via the dispensing channel 30 which becomes filled with liquid. The actuating stroke may be terminated either by the actuator 20 reaching a fully depressed position as shown in FIG. 7 or by reaching an intermittent position determined by the release of finger pressure by the operator. When finger pressure is released from the actuator 20, the actuator will begin to return to its rest position through a return stroke in which return movement is provided by action of the spring 13. In the absence of downward movement of the first piston 3, the pressure within the first chamber 4 ceases to become sufficient for the valve member 8 to be unseated from the seat 9 so that the valve member is returned by spring 13 to a position in which it closes the liquid delivery duct 7. At this point a residual quantity of liquid will generally remain within the dispensing channel 30.

As the actuator 20 begins its return stroke, the first piston 3 together with the first stem 6 begin to move upwardly relative to the second piston 39 and second stem 37 which initially remain static due to friction between the second piston and the second cylinder. This relative movement results in separation between the tubular projection 119 of the actuator and the inner tubular portion 115 thereby opening the gap which communicates between the air duct 38 and the liquid delivery duct 7 via the bore 120 provided in the first stem 6.

During the remainder of the return stroke, the volume of the second chamber expands thereby creating suction which is communicated to the dispensing channel 30 such that residual liquid is drawn through the air duct 38 into the second chamber. The residual liquid so collected will accumulate at the lower end of the second chamber 40, passing through the slots 109 into contact with the gasket 111. During the next actuating stroke, positive pressure within the second chamber 40 will expel the collected liquid via the check valve provided by the inner periphery 114 of the gasket 111 into the head space 108 so that the residual liquid is returned to the bulk of liquid contained within the container.

As can be seen from FIG. 7, the volume of the first chamber is reduced to an absolute minimum at the completion of the actuating stroke by shaping the valve member to be conformal to the interior of the first piston and by virtue of the constructional features of the extension 11 and lower portion 12 of the valve member. A high compression ratio of the first pumping means is thereby achieved and this facilitates the priming of the first chamber with liquid.

A further modified apparatus 130 is shown in FIG. 8 and will be described using corresponding reference numerals to those of FIG. 4 where appropriate for corresponding elements.

The apparatus 130 differs from the apparatus 101 of FIG. 4 in the construction of the actuator 20 and the end portion 24 of the first stem 6.

Whereas apparatus 101 has a radial bore 120, no such bore is provided in the end portion 24 of apparatus 130 which instead is provided with an axially extending groove 131 in the actuator 20 which cooperates with the outer cylindrical surface 132 of the end portion 24 to define a conduit communicating between the socket 22 and the dispensing channel 30.

During the return stroke of the apparatus 130, suction is applied to the dispensing channel 30 via the conduit defined by the groove 131 to thereby remove residual liquid which is then accumulated in the second chamber 40 and subsequently returned to the container during the next successive actuating stroke.

The dimensions of the first and second pistons 3,39 and first and second cylinders 5,40 are selected such that the volumetric displacements of the first and second pumping means 2,106 meet the requirements of the particular application to which the apparatus is designed. In the embodiment of FIG. 4, the apparatus 101 is designed to achieve equal volumetric displacements for the first and second pumping means 2,106 when measured over a complete actuating stroke so that the volume of liquid pumped from the container via the dip tube 17 is made equal to the total volume of residual liquid and air returned to the container via the check valve constituted by gasket 111. By this arrangement the pressure of contents within the container 107 remains substantially equal to ambient atmospheric pressure in use.

For certain applications it may be desirable to achieve a positive pressure within the container. This can be achieved by choosing dimensions for the components of the first and second pumping means 2,106 such that the volumetric displacement of the second pumping means is greater than that of the first pumping means. At each actuating stroke, the total volume of fluid comprising air and residual liquid displaced from the second chamber so as to enter the head space will then be greater than the volume of liquid dispensed so that the fluid must be compressed into a volume equal to the volumetric displacement of the first chamber. An accumulated positive pressure within the container is thereby established.

For other applications it may be desirable to achieve a negative pressure differential between the head space and ambient air, in which case the volumetric displacement of the second pumping means may be arranged to be less than that of the first pumping means.

In each of the preferred embodiments, the cylindrical extension 11 makes continuous sliding contact with the internal surface 15 of the tubular extension 16. The lower end portion 14 is maintained to an extent under radial compression within the tubular extension 16 by being a force fit. Such an arrangement has been found preferable to alternative constructions in which the cylindrical extension 11 would be made to slide externally on a re-entrant portion of the tubular extension, a problem with such constructions being that it is found necessary to disengage the tubular extension from the sliding surface in the rest position to avoid deformation over time into a set position in which good sealing contact was no longer made. In the configuration shown in the preferred embodiments, however, the cylindrical extension, when held in radial compression, is found to be more resistant to deformation so that separation in the rest position is not necessary.

By maintaining continuous sealing contact in the rest position as shown in the preferred embodiments, emptying of the first chamber 4 via the dip tube 17 during prolonged periods of non-actuation is avoided.

In the rest position between successive actuating strokes, a residual quantity of liquid will generally reside in the second chamber 40, and it is believed that the presence of this liquid contributes to avoiding the solidification of any traces of liquid in the narrow passageways of the dispensing channel 30 since the liquid provides a vapour permeating through the dispensing channel. An additional small quantity of liquid also will generally reside in the liquid delivery duct 7 at a level beneath the location at which suction is applied during the return stroke. In the case of FIG. 4 this level is that of the bore 120. Again the presence of this small quantity of liquid provides a vapour within the constricted dispensing channel 30 which avoids solidification of any traces of liquid which may remain after suction has removed the residual quantity of liquid.

For the above reason it is believed to be desirable to locate the bore 120 at a finite axial separation above the location of the valve seat 9 in order to retain a droplet of liquid at this position.

I claim:

1. A method of dispensing liquid from a container comprising the steps of:

actuating a reciprocatable first pumping means having a first chamber of variable volume so as to displace liquid from the first chamber during an actuating stroke of the first pumping means, recharging the first chamber with liquid from the container during a return stroke of the first pumping means, conducting liquid from the first chamber to a first nozzle via a dispensing channel during the actuating stroke such that a dispensed quantity of liquid is dispensed from the first nozzle and a residual quantity of the liquid remains in the dispensing channel, actuating during at least part of the actuating stroke and the return stroke of the first pumping means respectively a second pumping means having a second chamber of variable volume such that the volume of the second chamber is decreased during the actuating stroke and increased during the return stroke, connecting the second chamber by operation of a first valve means to the dispensing channel during the return stroke thereby withdrawing by suction the residual quantity of liquid into the second chamber, and connecting the second chamber by operation of a second valve means to an outlet port during a next subsequent actuating stroke.

2. A method as claimed in claim 1 wherein the outlet port communicates with the container and including the step of thereby returning the residual quantity of liquid to the container from the second chamber.

3. A method as claimed in claim 2 wherein the second valve means comprises a check valve whereby the second valve means opens in response to excess fluid pressure in the second chamber.

4. A method as claimed in claim 1 wherein the second chamber expands during the return stroke by a volume which is greater than the volume available within the dispensing channel to the residual quantity of liquid whereby the withdrawal of the residual quantity of liquid into the second chamber is accompanied by an inflow of air through the dispensing channel.

5. A method as claimed in claim 4 wherein the first and second pumping means displace substantially equal volumes from the respective first and second chambers during the actuating stroke.

6. A method as claimed in claim 1 wherein the first and second pumping means are actuated by depression of respective first and second actuating members relative to the first and second chambers, the first and second actuating members being connected by connection means providing lost motion between the first and second actuating members, and wherein the first valve means is operated to open and close communication between the dispensing channel and the second chamber in response to relative movement between the first and second actuating members provided by the lost motion.

7. A method as claimed in claim 6 wherein the first pumping means comprises a liquid inlet valve which is operable to admit liquid from the container to the first chamber and wherein the method comprises the steps of closing the liquid inlet valve during the actuating stroke and closing the first valve means during the actuating stroke prior to opening the liquid inlet valve.

8. Apparatus for dispensing liquid from a container comprising a reciprocatable first pumping means having a first chamber of variable volume and operable during an actuating stroke in response to movement of an actuator to displace liquid from the first chamber and to recharge the first chamber with liquid from the container during a return stroke, a dispensing channel defined by the actuator and communicating between the first chamber and a first nozzle for conducting pumped liquid during the actuating stroke, a second pumping means operable during at least part of the actuating stroke and the return stroke respectively in response to movement of the actuator and defining a second chamber of variable volume such that the volume of the second chamber is decreased during the actuating stroke and increased during the return stroke, a first valve means operable to connect the second chamber to the dispensing channel during the return stroke to thereby withdraw by suction residual liquid from the dispensing channel into the second chamber and a second valve means operable to discharge fluid from the second chamber during a next subsequent actuating stroke.

9. Apparatus as claimed in claim 8 wherein the second valve means defines an outlet port communicating between the second chamber and the container when the second valve means is opened.

10. Apparatus as claimed in claim 9 wherein the second valve means comprises a check valve responsive to excess fluid pressure in the second chamber.

11. Apparatus as claimed in claim 10 wherein the check valve is constituted by a tubular resilient gasket having an inner periphery sealingly engaging an external surface of a first cylinder which defines the first chamber, wherein the gasket is displacable therefrom to define the outlet port in response to excess pressure in the second chamber.

12. Apparatus as claimed in claim 11 wherein the gasket is formed integrally with a lip portion providing an annular seal between a mouth of the container and a body constituted by the first cylinder and a second cylinder, wherein the second cylinder defines the second chamber.

13. Apparatus as claimed in claim 8 wherein the volumetric displacement of the second pumping means during the actuating stroke is greater than the volume of the dispensing channel such that an inflow of air is drawn by suction through the dispensing channel into the second chamber.

14. Apparatus as claimed in claim 8 wherein the volumetric displacement of the first pumping means during the actuating stroke is substantially equal to the volumetric displacement of the second pumping means.

15. Apparatus as claimed in claim 8 wherein the first and second pumping means are actuable by depression of respective first and second actuating members relative to the container, the apparatus further comprising connection means providing lost motion between the first and second actuating members and wherein the first valve means is operable to open and close communication between the dispensing channel and the second chamber in response to relative movement between the first and second actuating members provided by the lost motion.

16. Apparatus as claimed in claim 15 wherein the connection means is constituted by the actuator being fixedly connected to the first actuating member, the actuator defining a socket receiving an end portion of the second actuating member and there being provided cooperating stop formations on the second actuating member and the actuator to limit relative movement therebetween.

17. Apparatus as claimed in claim 15 wherein the first actuating member comprises a first tubular stem defining a liquid delivery duct communicating between a liquid outlet valve of the first pumping means and the dispensing channel.

18. Apparatus as claimed in claim 17 wherein the first tubular stem is provided with a radial bore communicating between the delivery duct and the first valve means and wherein the bore is axially spaced from the first valve means.

* * * * *